US005718166A

United States Patent [19]

Phillips

[11] Patent Number: 5,718,166

[45] Date of Patent: Feb. 17, 1998

[54] METHOD FOR MAKING PIPE MADE OF DISCARDED VEHICLE TIRES

[75] Inventor: James M. Phillips, Prince Edward Island, Canada

[73] Assignee: B. & J. Industries Ltd., Cornwall, Canada

[21] Appl. No.: 707,171

[22] Filed: Sep. 3, 1996

[51] Int. Cl.[6] ..... B65B 27/06

[52] U.S. Cl. ..... 100/3; 100/6; 100/12; 100/95; 100/98 R; 100/220; 100/264; 138/155

[58] Field of Search ..... 100/3, 6, 12, 39, 100/95, 98 R, 220, 264; 138/120, 155, 177

[56] References Cited

U.S. PATENT DOCUMENTS

| | | | |
|---|---|---|---|
| 1,464,010 | 8/1923 | Miller | 100/12 |
| 3,951,384 | 4/1976 | Hildreth, Jr. . | |
| 4,006,678 | 2/1977 | Laurie et al. . | |
| 4,095,560 | 6/1978 | Laurie et al. . | |
| 4,222,323 | 9/1980 | Martindale . | |
| 5,056,428 | 10/1991 | Allen | 100/12 |
| 5,121,680 | 6/1992 | Nordberg . | |
| 5,152,214 | 10/1992 | Nordberg . | |
| 5,178,489 | 1/1993 | Suhayda . | |
| 5,236,756 | 8/1993 | Halliburton . | |
| 5,238,228 | 8/1993 | Moon . | |
| 5,347,919 | 9/1994 | Nordberg . | |
| 5,427,022 | 6/1995 | Gardner | 100/214 |

FOREIGN PATENT DOCUMENTS

| | | | |
|---|---|---|---|
| 51-16230 | 5/1976 | Japan | 100/98 R |
| 51-16231 | 5/1976 | Japan | 100/98 R |
| 51-16232 | 5/1976 | Japan | 100/98 R |
| 863462 | 9/1981 | U.S.S.R. | 100/12 |
| 925769 | 5/1982 | U.S.S.R. | 100/12 |
| 1810713 | 4/1993 | U.S.S.R. | 138/155 |

*Primary Examiner*—Stephen F. Gerrity
*Attorney, Agent, or Firm*—Mario D. Theriault

[57] ABSTRACT

An apparatus and a method for making pipes made of a plurality of axially juxtaposed discarded vehicle tires wherein several batches of vehicle tires are sequentially compressed against one-another for forming long pipes of discarded tires. In one aspect of the apparatus of the present invention, there is provided a telescopic mandrel having a first and second spaced apart compactor plates mounted thereon for compacting a batch of vehicle tires therebetween. A plurality of grabbing jaws mounted on the telescopic mandrel at an intermediate position between the compactor plates grabs and retains the batch of tires in a compressed mode against the second compactor plate, while the telescopic mandrel is extended for loading a second or subsequent batch of vehicle tires thereon. In another aspect of the invention, there is provided several spacer strips on the telescopic mandrel for holding vehicle tires of the same rim size in alignment with the telescopic mandrel. There is further provided a plurality of spearheaded plungers mounted on the second compactor plate for puncturing holes through the sidewalls of all tires in a batch of compressed tires and for pulling tie rods or strapping bands back through these holes. The apparatus of the present invention also comprises a band saw mounted thereon for slabbing pipes made of vehicle tires or for making square logs of discarded vehicle tires.

5 Claims, 9 Drawing Sheets

METHOD FOR MAKING PIPE MADE OF DISCARDED VEHICLE TIRES

FIELD OF THE INVENTION

This invention relates to machines for compressing discarded vehicle tires, and more particularly it relates to a machine for compressing a large quantity of discarded vehicle tires in a multiplicity of successive compressing cycles.

BACKGROUND ON THE INVENTION

The disposal of discarded tires is a concern for many municipalities. Piles of used tires can sometimes reach enormous proportions, and the danger of accidentally igniting these piles is a continuous threat to nearby residents.

Therefore, it is a modem trend that civil service employees, architects and engineers are more and more agreeable to consider the use of alternative construction products made of discarded vehicle tires. Rubber material is inherently resistant to a diversity of weather conditions. It does not corrode when immersed in sea water or degrade when buried in the ground for many years. Therefore several new products made of discarded tires are potentially more resistant to corrosion and fretting than some conventional products such as concrete and steel for example.

In recent years a variety of new products have been developed by innovators to utilize discarded vehicle tires as a primary material of fabrication. Products made of baled vehicle tires or portions of baled tires are numerous and include:

- an impact absorbing device as illustrated and described in U.S. Pat. No. 3,951,384, issued on Apr. 20, 1976 to Robert E. Hildreth, Jr.;
- artificial reefs and fish habitats as described in U.S. Pat. No. 4,095,560 issued on Jun. 20, 1978 to Albert F. Laurie et al.;
- beach stabilizers as described in U.S. Pat. No. 5,178,489 issued on Jan. 12, 1993 to Joseph Suhayba;
- and a culvert pipe as described in U.S. Pat. No. 5,236,756, issued on Aug. 17, 1993 to Danny B. Halliburton.

In the past, various machines have been developed to compress discarded vehicle tires into the above useful products or simply for making bundles of tires easily manipulated and disposed of. A first example of a tire compressing machine is described in U.S. Pat. No. 4,006,678 issued on Feb. 8, 1977 to Mr. Albert F. Laurie et al. The machine illustrated therein is capable of compressing batches of approximately ten passenger car tires. The machine has a press platen for pressing the tires into the form of a bale, and a knife platen for cutting radial slits at several places around the periphery of the bale. This machine is used to manufacture artificial fish habitats as described in the aforesaid U.S. Pat. No. 4,095,560.

Another type of tire compressing machine has a telescoping mandrel and is illustrated in at least three U.S. patents issued to the same inventor; Mr. Herny T. Nordberg. The inventive features of these machines are described respectively in U.S. Pat. No. 5,121,680 issued on Jun. 16, 1992, in U.S. Pat. No. 5,152,214, issued on Oct. 6, 1992, and in U.S. Pat. No. 5,347,919, issued on Sep. 20, 1994.

U.S. Pat. No. 5,121,680 describes a telescoping mandrel having a fixed and a movable compactor plate for compressing a row of tires therebetween. The movable plate is actuated by an hydraulic cylinder. U.S. Pat. No. 5,152,214 describes a machine wherein the row of tires is compressed between two compactor plates actuated toward and away from one-another by a dual-chamber hydraulic cylinder. U.S. Pat. No. 5,347,919 is about a telescoping mandrel having a fixed compactor plate and a movable compactor plate, wherein the movable compactor plate is easily detachable from the moving end of the mandrel. The latter patent goes along to describe wire guides disposed on the movable probe for receiving binding wires there along, so that a wire can be wrapped about the compressed row of tires. The machines described in the above three patents can form bundles of approximately 20–30 tires.

As a further example of a tire compressing machine, U.S. Pat. No. 5,427,022 issued on Jun. 27, 1995 to Donald M. Gardner describes an apparatus having a support frame for supporting a radially exterior bottom portion of a plurality of tires in a generally axially aligned position with one-another. A telescoping hydraulic cylinder pushes a ram member into a guiding frame for compressing the plurality of tires supported within this frame. This machine can compress about 22 to 50 tires into a single bale of tires. A pair of baling wire are slipped over the bale of tires to hold them in the compressed state.

The above prior art machines operate in a single stroke mode, wherein a single batch of discarded tires is placed about a telescoping mandrel or inside a supporting frame and is compressed axially. The compact bundle is then tied and removed from the mandrel or from a supporting cradle.

A tire from a passenger car is known to be compressible by a factor of about 7 to 1, that is from a width of about 7 or 8 inches to a thickness of about 1 or 1½ inch. Hence the single stroke machines of the prior an are limited in the number of tires which may be compressed thereon by a practical length of the telescoping mandrel. A single stroke telescoping mandrel for forming a long pipe of 100 or more discarded vehicle tires for example, would have a extended length of in excess of 60 feet. Designing and manufacturing a machine of such proportion is relatively difficult and expensive, and a transportation thereof between piles of discarded vehicle tires is impractical.

Therefore the products manufactured by compressing discarded vehicle tires was traditionally limited to products having a length of no more than about 2 to 4 feet.

SUMMARY OF THE INVENTION

In the present invention, however, there is provided a relatively compact apparatus for compressing vehicle tires, wherein several batches of vehicle tires are sequentially compressed against one-another for forming long pipes of discarded vehicle tires.

In one aspect of the apparatus of the present invention, there is provided essentially a support structure supporting a telescopic mandrel, a grabber module and an hydraulic power supply unit hydraulically connected to the telescopic mandrel and to the grabber module for supplying hydraulic power thereto.

The telescopic mandrel comprises an elongated tubular casing having a base portion rigidly supported on the support structure and a jut portion projecting beyond the base portion in an overhung mode. The tubular casing further comprises a closed end adjacent the base portion and an opened end adjacent the jut portion.

The apparatus of the present invention further has an elongated cylindrical tubing having an enclosed end and a free end, and is telescopically mounted inside the tubular casing such that the free end extends through the opened end of the tubular casing. A first hydraulic actuator is mounted inside the tubular casing and is connected to the closed end of the tubular casing and to the free end of the cylindrical tubing for effecting an extension and a retraction of the cylindrical tubing relative to the tubular casing. A distance of extension and retraction of the free end of the cylindrical tubing is thereby a stroke length of the first hydraulic actuator measured from the opened end of the tubular casing.

The apparatus of the present invention also comprises a first compactor plate detachably mounted on the free end of the cylindrical tubing for allowing placement of a batch of vehicle tires thereon. The first compactor plate is mounted in a perpendicular orientation with the cylindrical tubing for applying a compressive force on the batch of vehicle tires mounted on the telescopic mandrel in a direction of retraction of the cylindrical tubing.

There is also provided a second compactor plate mounted on the tubular casing in a perpendicular orientation therewith, and about the jut portion thereof, for applying a compressive force on the batch of vehicle tires in a direction toward the first compactor plate.

The grabber module of the apparatus of the present invention has a frame member mounted on the support structure for supporting an effective portion thereof in a fixed longitudinal relationship with the tubular casing, and near the opened end of this tubular casing. The effective portion of the grabber module comprises a plurality of gabbing jaws disposed in a radial array about the tubular casing, and a second hydraulic actuator means for actuating each of the gabbing jaws toward and away from the tubular casing.

A first advantage of the apparatus of the present invention is that when a first batch of vehicle tires is loaded on the cylindrical tubing and is compressed between the first and second compactor plates, the grabbing jaws are actuated toward the tubular casing for gabbing and retaining the batch of vehicle tires in a compressed mode against the second compactor plate.

The cylindrical tubing may thereby be extended for loading a second or subsequent batch of tires thereon. This compressing, gabbing and loading cycle is repeated until a proper quantity of tires required to make a long pipe of vehicle tires is compressed between the compactor plates.

In accordance to another aspect of the apparatus of the present invention, the jut portion of the telescopic mandrel has on an outside surface thereof a plurality of spaced apart spacer strips aligned along the longitudinal axis of the mandrel, for supporting the batch of vehicle tires in an axial alignment with the jut portion. Each spacer strip has a transition member near the opened end of the tubular casing. Each transition member is a wedge-like member sloping outwardly from a surface of the cylindrical tubing toward an outside surface of a respective spacer strip. Therefore, when a pipe is formed on these spacer strips, using vehicle tires each having a same nominal rim size, the inside diameter of that pipe is relatively smooth.

In accordance to another aspect of the apparatus of the present invention, there is provided a third hydraulic actuator means connected to the base portion of the tubular casing and to the second compactor plate for moving the second compactor plate along the jut portion.

The third hydraulic actuator means provides an additional compressing stage at the end of a pipe forming cycle described above, by pushing the second compactor plate toward the first compactor plate. This final compressing stage is effected while all vehicle tires are properly positioned and centered about the jut portion. The long pipe of vehicle tires thus formed remains straight and uniform in diameter when tied in this condition.

In accordance to another aspect of the apparatus of the present invention, the second compactor plate has a plurality of spearheaded plungers mounted thereon. The plungers are operable hydraulically toward the first compactor plate for puncturing holes through the sidewalls of all tires in a batch of vehicle tires, while this batch of tires is held in a compressed mode between the first and second compactor plates.

Each spearheaded plunger has a threaded rod end for removably receiving either a spear point for puncturing a hole through the sidewalls of tires, or a clevis connection for pulling a tie rod through a hole formed through the sidewalls. The pipe of vehicle tires tied in this manner is held in a compressed and a relatively rigid condition by a plurality of tie rods and holding plates.

In accordance with a further aspect of the apparatus of the present invention, there is provided a band saw movably mounted on two rail members aligned with the tubular casing. The band saw is operable to cut a longitudinal cross-sectionally arcuated segment from an outside surface of the pipe of vehicle tires, thereby forming a flat surface along that pipe. The pipe can thereby be installed in the ground, as a culvert pipe for example, at shallow depth.

In accordance to yet another aspect of the present invention, there is provided a method for manufacturing pipes made of discarded vehicle tires. Such manufacture is effected on an apparatus comprising a telescopic mandrel, a first compactor plate removably mounted on the free end of an extensible portion of that mandrel, a second compactor plate mounted on an intermediate position along a fixed portion of that telescopic mandrel, and a compression retention means rigidly mounted between the first and second compactor plates. The method of the present invention comprises the steps of:

a) removing the first compactor plate from the free end of the extensible portion of the telescopic mandrel;
b) placing a first batch of discarded vehicle tires on the extensible portion of the telescopic mandrel,
c) installing the first compactor plate on the free end of the extensible end of the telescopic mandrel;
d) moving the extensible portion and the first compactor plate toward the second compactor plate thereby compressing the first batch of discarded vehicle tires against the second compactor plate;
e) retaining with the compression retention means the first batch of vehicle tires in a compressed mode against the second compactor plate;
f) extending the extensible portion of the telescopic mandrel and loading a second or subsequent batch of vehicle tires on this extensible portion;
g) compressing the second or subsequent batch of discarded vehicle tires against the first batch, thereby forming a pipe of discarded vehicle tires;
h) tying that pipe of vehicle tires for retaining a compressed state of that pipe.

A major advantage of this method of making pipes of vehicle tires is that long pipes may be manufactured on a telescopic mandrel which has a relatively short stroke length. The apparatus for making pipes is thereby relatively compact in size and easily transported on a highway.

BRIEF DESCRIPTION OF THE DRAWINGS

The preferred embodiments of the invention will be further understood from the following description, with reference to the drawings in which.

DETAILED DESCRIPTION OF THE PREFERRED EMBODIMENT

Figure 1:
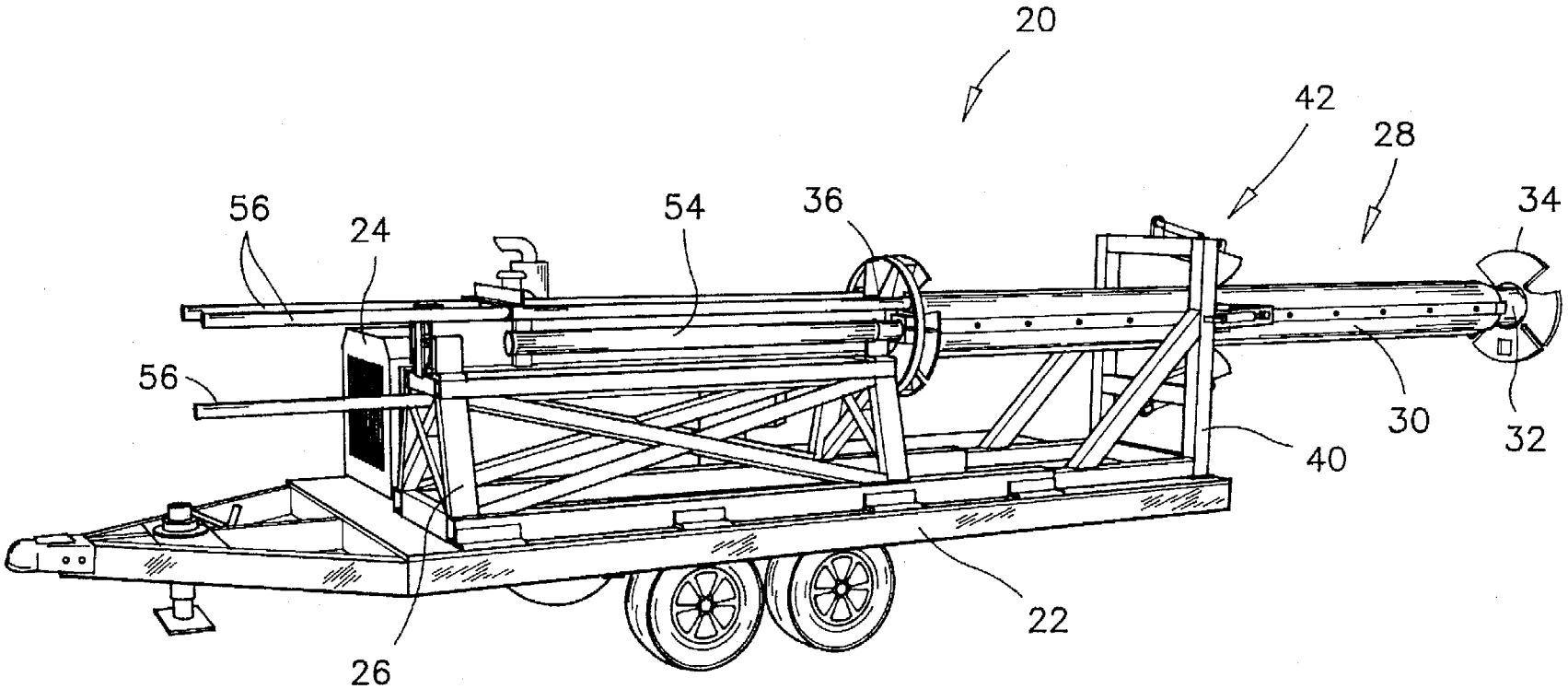
FIG. 1 is a perspective front and right side view of the tire compressing machine of the preferred embodiment.
Figure 2:
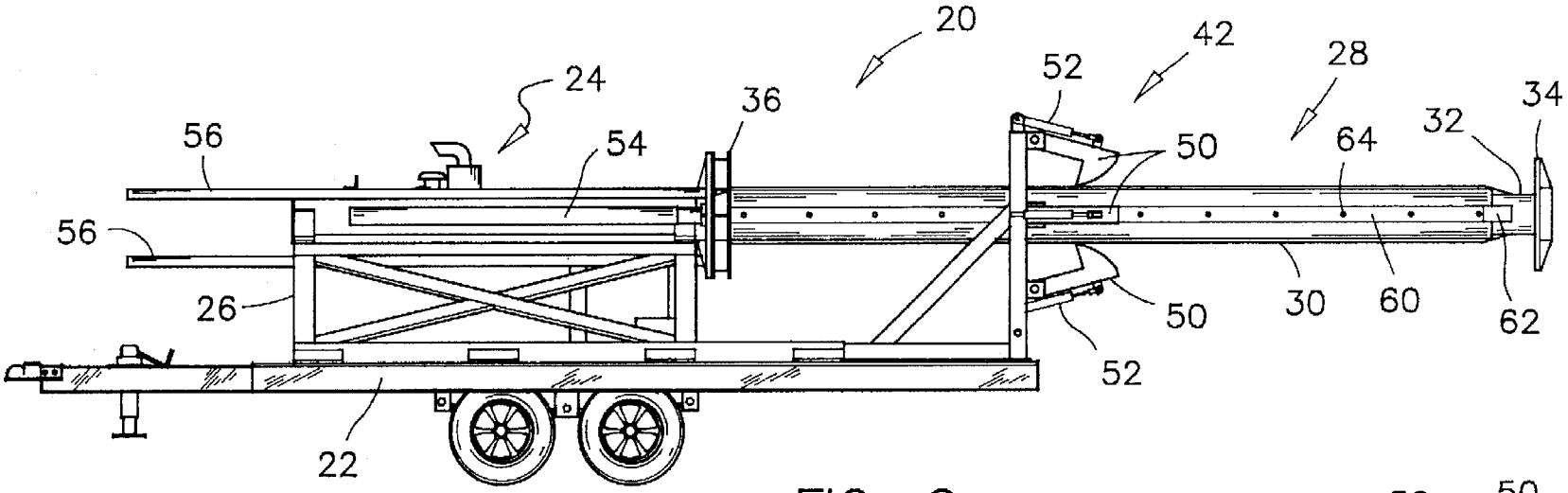
FIG. 2 is a right side view of the tire compressing machine of the preferred embodiment showing the telescoping mandrel and grabber assembly in a retracted position during transportation of the machine.
Figure 3:
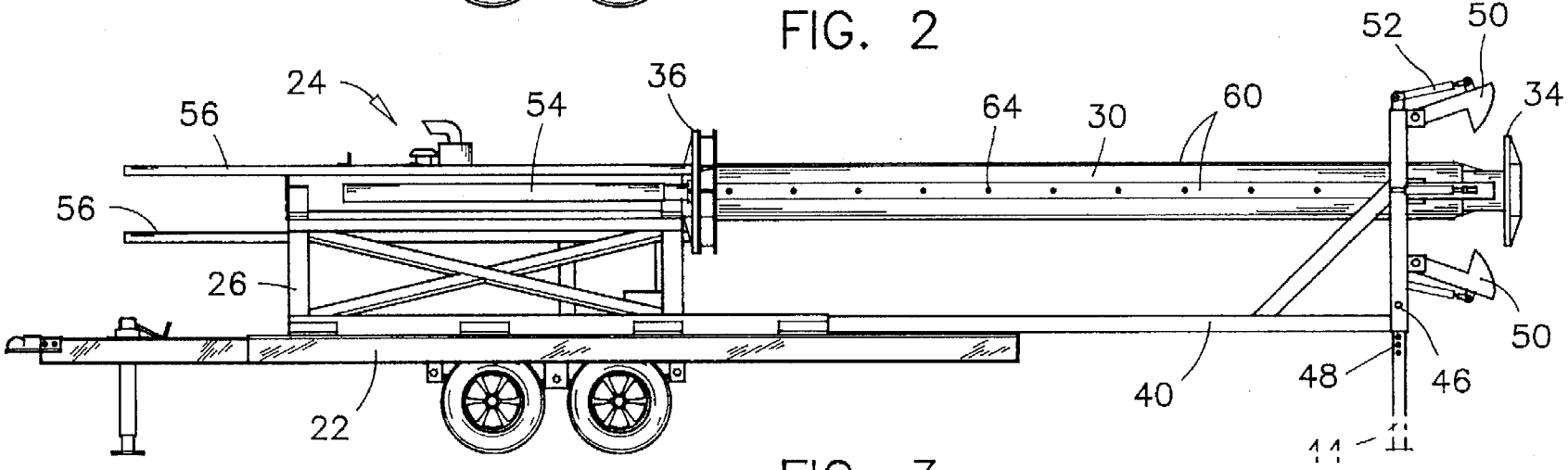
FIG. 3 is also a right side view of the tire compressing machine with the grabber assembly in a fully extended position during operation of the machine.

Referring to FIGS. 1, 2 and 3, the tire compressing machine 20 of the preferred embodiment is mounted on a trailer 22, and is powered by an engine-driven hydraulic power supply unit 24. The tire compressing machine 20 is thereby movable behind a vehicle from a pile of discarded tires to another, and is readily operable as a stand alone unit.

The hydraulic hoses, valves and controls for operating this machine are not shown herein for being of the common type, and for being well known to persons skilled in the art of hydraulic systems. Similarly, several mechanical details have been omitted in the accompanying drawings. These details are also evident to persons knowledgeable in the art, and were not drawn for providing a better clarity to the drawings.

The tire compressing machine 20 has a support structure 26 for supporting a fixed end of an overhung telescopic mandrel 28. The telescopic mandrel 28 has a tubular casing 30 affixed at a first end to the support structure 26, and a cylindrical tubing 32 sliding inside and protruding from, the opened end of the tubular casing 30. The cylindrical tubing 32 has a first compactor plate 34 removably mounted on its free end. A second compactor plate 36 is mounted at an intermediate position along the tubular casing 30.

The tire compressing machine of the preferred embodiment further has a movable structure 40 on which is mounted a grabber assembly 42. The movable structure 40 is illustrated in a retracted position in FIGS. 1 and 2, and in a fully extended position in FIG. 3. The operation of the grabber module 42 will be explained later when making reference particularly to FIGS. 8 and 9.

The movable structure 40 has a pair of legs 44 for supporting the grabber module 42 on the ground in a fully extended and operational mode. Each leg 44 is vertically adjustable by means of a pin 46 in a member of the structure 40 mating in one of a series of holes 48 in that leg.

The grabber assembly 42 preferably has four grabbing jaws 50 which are actuated in a radial direction relative to a cross-section of the telescopic mandrel 28 by four hydraulic cylinders 52. When the tire compressing machine 20 of the preferred embodiment is transported from site to site, the grabbing jaws 50 are preferably held against the telescopic mandrel 28 for preventing excessive vibration and deflection of the telescopic mandrel 28 due to road irregularities.

The second compactor plate 36 is movable along the tubular casing 30 toward the first compactor plate 34 by means of two hydraulic cylinders 54 mounted on a base portion of the tubular casing 30. The second compactor plate 36 further carries three hydraulic spear-ended plungers 56 for puncturing the sidewalls of all tires in a compressed bundle of vehicle tires.

The tubular casing 30 preferably has four spacer strips 60 attached longitudinally of the outside surface of an overhung or jut portion thereof. The spacer strips 60 are spaced apart around the circumference of the jut portion at about 90° from one another. The purpose of these spacer strips 60 is to support the tires on the tubular casing in a common alignment with one another and with the longitudinal axis of tubular casing 30.

A wedge-like transition member 62 is also mounted on the tubular casing 30 at the extremity of each spacer strip 60 nearest to the first compactor plate 34. Each transition member 62 is sloped outwardly from the surface of the cylindrical tubing 32 toward an outside surface of a respective spacer strip 60. The spacer strips 60 and the transition members 62 ensure that a tire being moved by the cylindrical tubing 32 and the first compactor plate 34 is slid over the transition member 62 and is positioned in substantial alignment with a longitudinal axis of the tubular casing 30.

Therefore, the tires to be processed in a batch of vehicle tires are preferably preselected according to their nominal rim sizes such that the inside and outside surfaces of the cluster of tires are relatively smooth.

The spacer strips 60 and transition members 62 are replaceable with other spacer strips and transition members having different thicknesses to accommodate different tire rim sizes. For this reason, the spacer strips 60 and transition members 62 are preferably held to the tubular casing by means of screws 64 accessible from an outside region of the tubular casing 30. The spacer strips 60, transition members 62 and holding screws 64 are better seen in FIG. 4.

Figure 4:
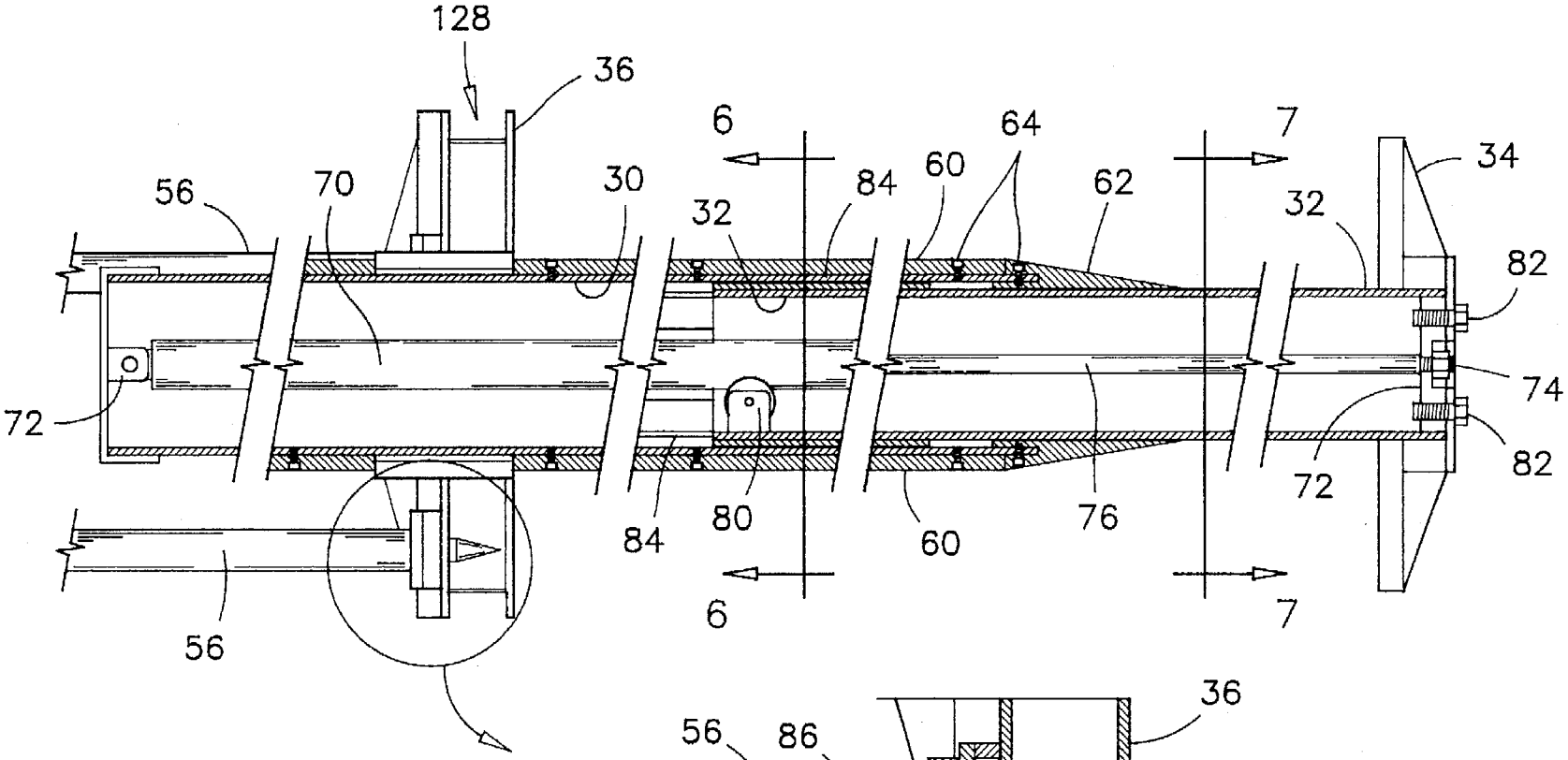
FIG. 4 is a partial cross-section of the telescopic mandrel of the tire compressing machine of the preferred embodiment.
Figure 5:
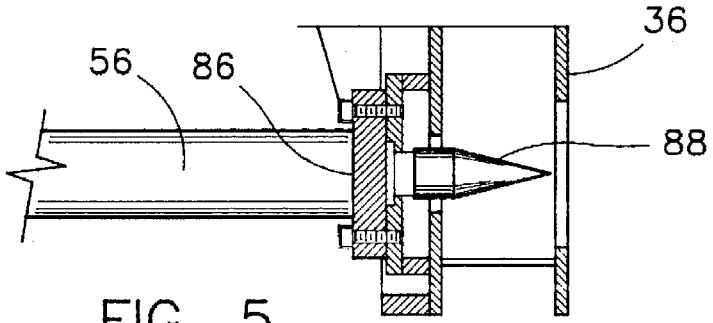
FIG. 5 is an enlarged view of Detail 5 of FIG. 4.

Referring now specifically to FIGS. 4 and 5, the telescopic mandrel 28 is operated by an hydraulic cylinder 70 mounted inside the tubular casing 30 and cylindrical tubing 32. The casing end of this hydraulic cylinder 70 is mounted on a clevis bracket 72 on the closed end of the tubular casing 30. The rod end 76 of the hydraulic cylinder 70 is mounted into a cap plate 72 inside the free end of the cylindrical tubing 32, by means of a hole in this cap plate 72 and a nut 74 on the threaded end of the cylinder rod 76.

The casing of the hydraulic cylinder 70 is supported at an intermediate region by a roller 80 and bracket mounted inside the enclosed end the cylindrical tubing 32, for preventing excessive deflection of this cylinder 70 when it is fully extended. The first compactor plate 34 is mounted over the free end of the cylindrical tubing 32, and is held over the free end by means of screws 82 threaded through the cap plate 72. The first compactor plate 34 is removed from the free end of the cylindrical tubing 32 for mounting vehicle tires on the tubing, by removing all holding screws 82, and by sliding the plate 34 off the tubing 32.

The cylindrical tubing 32 is guided inside the tubular casing by an array of guide strips 84 mounted inside the tubular casing 30 and over the enclosed end of the cylindrical tubing 32.

Each plunger cylinders 56 is mounted on the second compactor plate 36 by means of a front-flange-type mounting arrangement 86 held against a back surface of the compactor plate 36. The rod of each plunger cylinder 56 has a spear point 88 for puncturing a hole through the sidewall of all tires in a compressed bundle of discarded tires.

Figure 7:
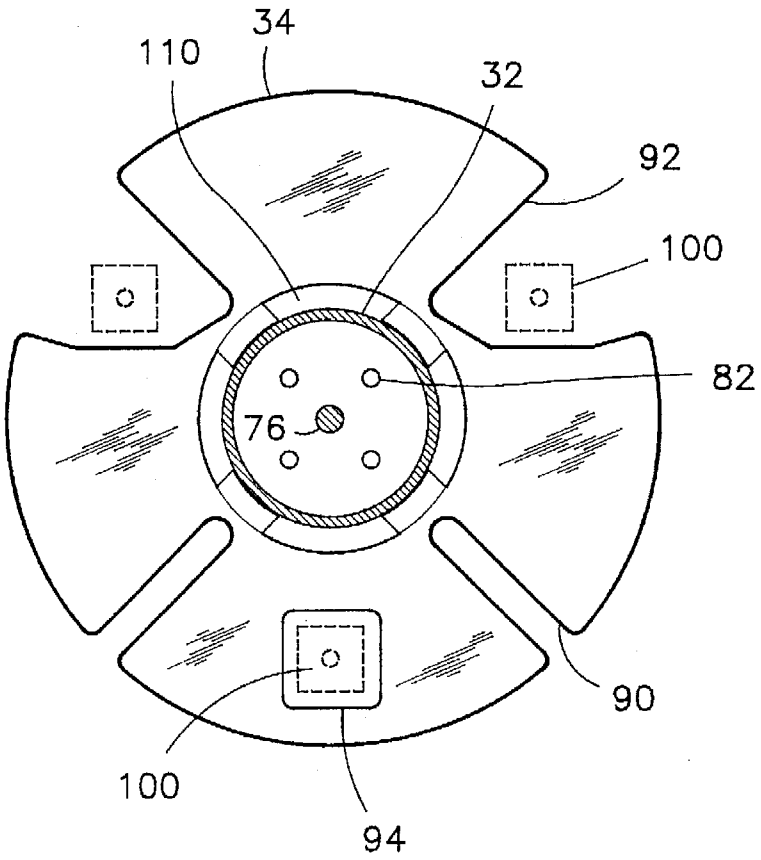
FIG. 7 is a transversal cross-section of the telescopic mandrel of the tire compressing machine of the preferred embodiment along line 7—7 of FIG. 4.
Figure 6:
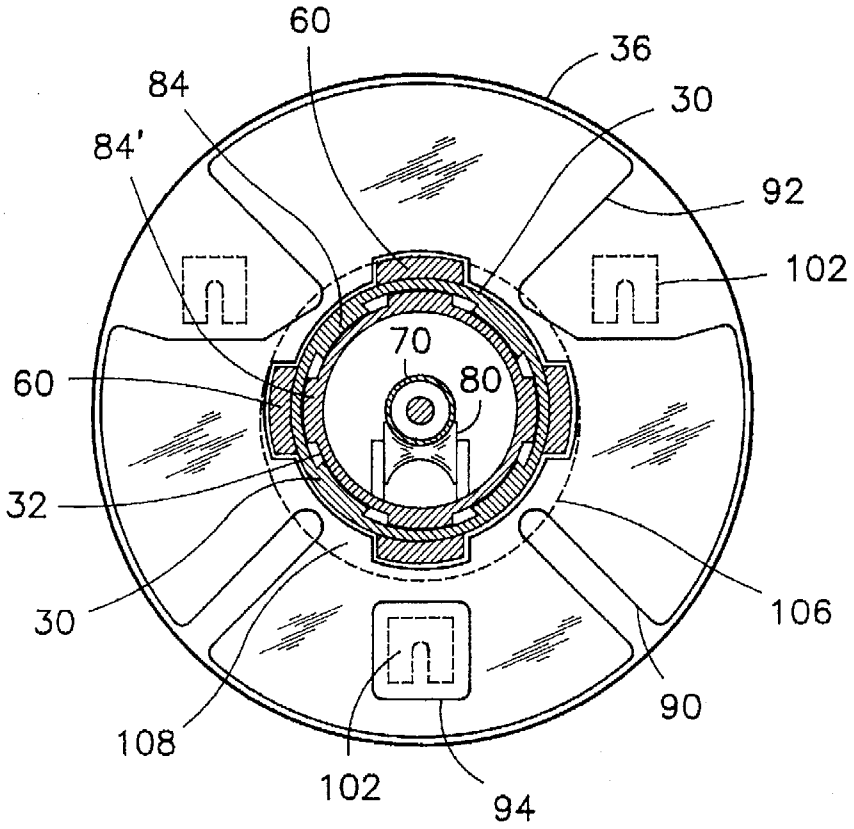
FIG. 6 is a transversal cross-section of the telescopic mandrel of the tire compressing machine of the preferred embodiment along line 6—6 of FIG. 4.

There is illustrated in FIG. 6, a cross-section view through the tubular casing 30 and a plan view of the second compactor plate 36. Similarly, FIG. 7 illustrates a cross-section view through the cylindrical tubing 32, and a plan view of the first compactor plate 34. Both compactor plates 34 and 36 have radial slots 90 and openings 92 for sliding a strapping band therethrough when trying a bundle of discarded tires with such bands.

The openings 92 are somewhat larger than slots 90 for alternatively allowing therethrough a holed holding plate 100 or a slotted holding plate 102 when trying a bundle of discarded tires with tie rods through the sidewalls of the tires. Accordingly, the compactor plates 34 and 36 have each a closed opening 94 in a lower region thereof for allowing installation of a third tie rod through the bundle of tires.

Holed holding plates 100 and slotted holding plates 102 are shown in dotted lines to facilitate the understanding of the function of openings 92 and 94 when trying a bundle of vehicle tires with tie rods, according to a first preferred method of trying a bundle of vehicle tires.

As it was explained earlier, the cylindrical tubing 32 is guided inside the tubular casing 30 by means of a first plurality of guide strips 84 attached inside the tubular casing 30 and a second plurality of guide strips 84' mounted over the enclosed end of the cylindrical tubing 32 as seen in FIG. 6. The guide strips 84 and 84' are preferably made of a wear resistant material such as Teflon™, and are installed in an usual manner as is customary in the fabrication of telescopic booms for cranes for example.

As it was also explained earlier, discarded tires are positioned on the tubular casing 30 such that an inside diameter of each tire, represented by dashed line 106 in FIG. 6, is held over spacer strips 60 in relative axial alignment with the tubular casing 30. When a number of tires are placed on the tubular casing 30, void spaces 108 are created between each spacer strips 60, tire beads 106 and a surface of the tubular casing 30.

In a second preferred method of trying a bundle of vehicle tires, strapping bands are preferably pushed through these void spaces 108 and through slots 90 and 92 for tying the bundle of discarded tires with such bands.

The first compactor plate 34 has four openings 110 for providing clearance over the transition members 62 when the plate 34 is brought near the opened end of the tubular casing 30 during compaction of a bundle of tires.

Figure 8:
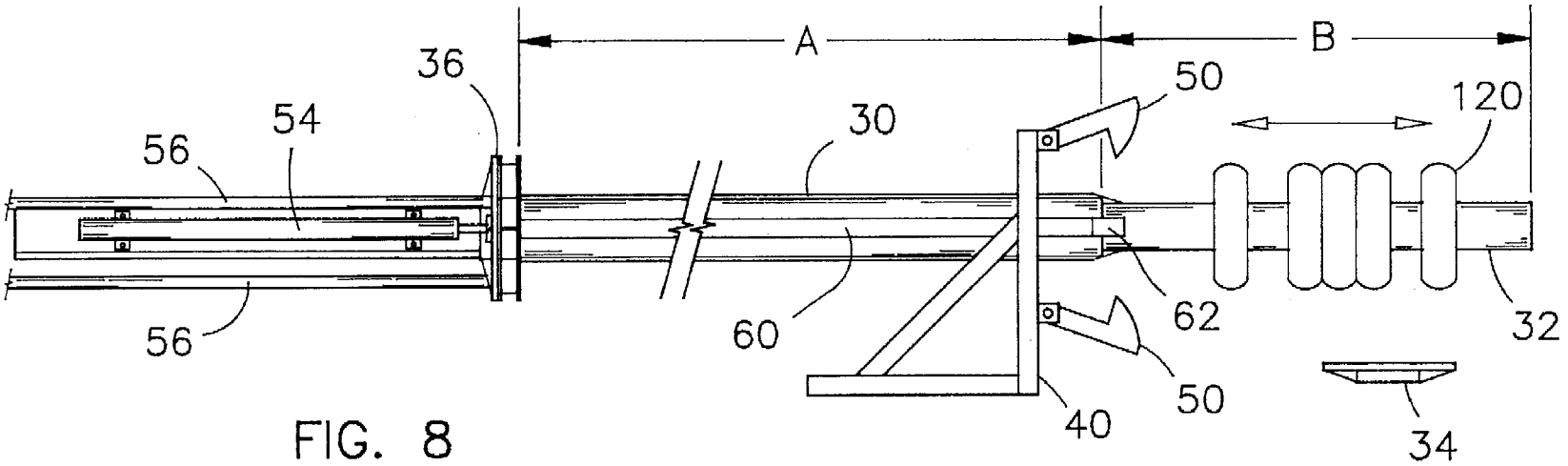
FIG. 8 illustrates a fight side view of the telescopic mandrel of the tire compressing machine of the preferred embodiment in an operating mode when discarded vehicle tires are being placed thereon.
Figure 9:
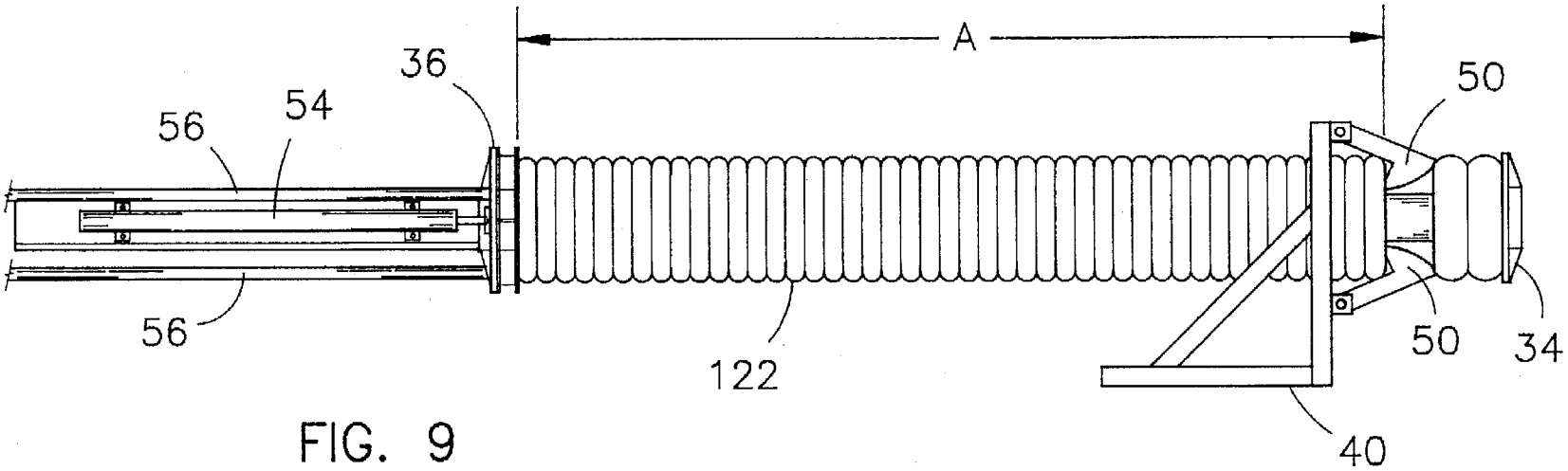
FIG. 9 is also a right side view of the telescopic mandrel of the tire compressing machine of the preferred embodiment when several batches of discarded vehicle tires have been compressed into a single cluster of tires on the tubular casing thereof.
Figure 10:
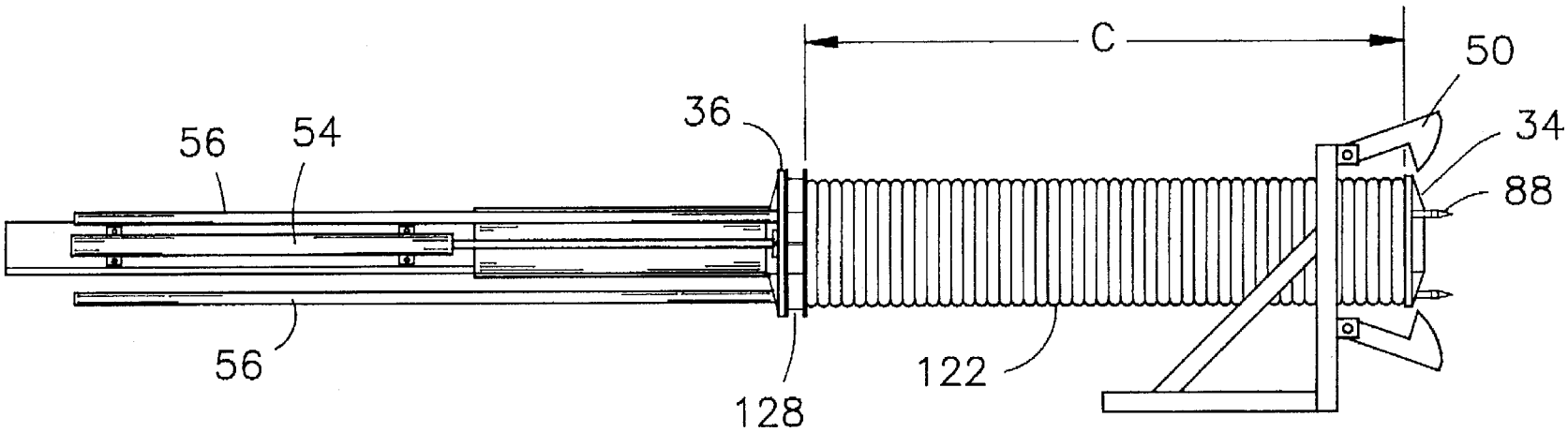
FIG. 10 is also a right side view of the telescopic mandrel of the tire compressing machine of the preferred embodiment when the second compactor plate compresses the cluster of discarded vehicle tires.

Referring now to FIG. 8, 9 and 10, there is illustrated therein a preferred method of operation of the tire compressing machine 20 of the preferred embodiment. The tire compressing machine 20 of the preferred embodiment is capable of compressing a quantity of about 105 passenger car tires into a cluster, or a pipe of tires of about ten feet long.

The jut portion of the tubular casing 30 has a length shown as "A" of about 15 feet. The stroke length of the sliding tubing 32 as shown by label "B" is preferably 20 feet, but a shorter stroke length is also acceptable.

With the first compactor plate 34 removed, a first batch of discarded vehicle tires 120 is placed over the cylindrical tubing 32 as illustrated in FIG. 8. The first compactor plate 34 is then reinstalled on the free end of the cylindrical tubing 32, and the cylindrical tubing 32 is retracted inside the tubular casing 30 forcing the tires 120 over the transition members 62 and onto the spacer strips 60. Subsequent batches of discarded tires 120 are likewise pushed over the tubular casing 30 until the tubular casing 30 is full of uncompressed tires.

When the tubular casing 30 and cylindrical tubing 32 are full of uncompressed tires, and a further retraction of the cylindrical tubing 32 is effected, the grabber jaws 50 are actuated inwardly toward the tubular casing 30 preventing thereby a loosening of the compressed bundle of tires 122. A number of additional batches of discarded tires are further added to the compressed batch until the total count of discarded tires on the tubular casing 30 is about 105. This further addition of batches of tires is effected by alternatively opening the grabber jaws 50 during the retracting of the first compactor plate 34, and closing of the grabber jaws 50, as shown in FIG. 9, during the returning of the first compactor plate 34 to an extended position.

Figure 11:
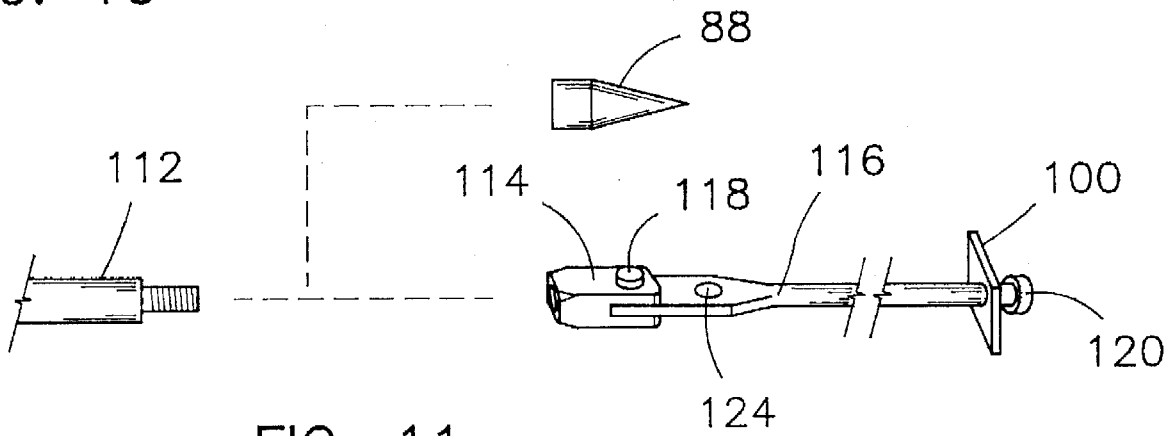
FIG. 11 is an enlarged view of the rod end of a spear-ended plunger, a spear point, a clevis connection and a tie rod used in tying a bundle of discarded vehicle tires.

Referring now specifically to FIGS. 10 and 11, there is illustrated therein the final compression stage of a bundle of discarded tires and a first preferred method for tying this bundle. When the total count of compressed tires in a bundle of tires is about 105, the second compactor plate 36 is pushed toward the first compactor plate 34 by two hydraulic cylinders 54, one on each side of the tubular casing 30. The preferred stroke length of hydraulic cylinders 54 is 72 inches such that a fully compressed length of a bundle of tires, as shown by label "C" is about 9 feet.

At this point the spearheaded plunger cylinders 56 are actuated for extending the plungers and puncturing holes through the sidewalls of all tires in the bundle 122. During this operation, the grabber jaws 50 are opened and both compactor plates 34 and 36 are under pressure for holding the bundle 122 in a fully compressed mode. The plunger cylinders 56 are extended fully until the spear point 88 of each plunger protrudes through the openings 92 and 94 of the first compactor plate 34 as seen in FIG. 10.

The spear points 88 are then removed from the plunger rod 112 of the plunger cylinders 56, and a clevis connection 114 is mounted on each plunger rod 112. A tie rod 116 is attached into the clevis connection 114 by means of a pin 118. Each plunger rod 112 is then retracted pulling a tie rod 116 through the bundle of discarded tires.

Each tie rod 116 preferably has an enlarged portion 120 at a free end thereof for retaining a holed holding plate 100 during the installation of the tie rod through the bundle. Each tie rod 116 also preferably has two holes on a retained end thereof, wherein a first hole is used to mount the rod 116 into the clevis connection 114, and the other hole 124 is used to retain a slotted holding plate 102 by means of a lock pin 126 as better seen in FIG. 12. The installation of this slotted holding plate 102 is done through access space 128 in the second compactor plate 36, as illustrated in FIGS. 4 and 10.

The length of the tie rods between the head portion 120 and hole 124 is preferably 10 feet. Therefore, when the pressure of the compactor plates 34 and 36 is released, the total length of the bundle of tires extends to approximately 10 feet.

Figures 12, 13:
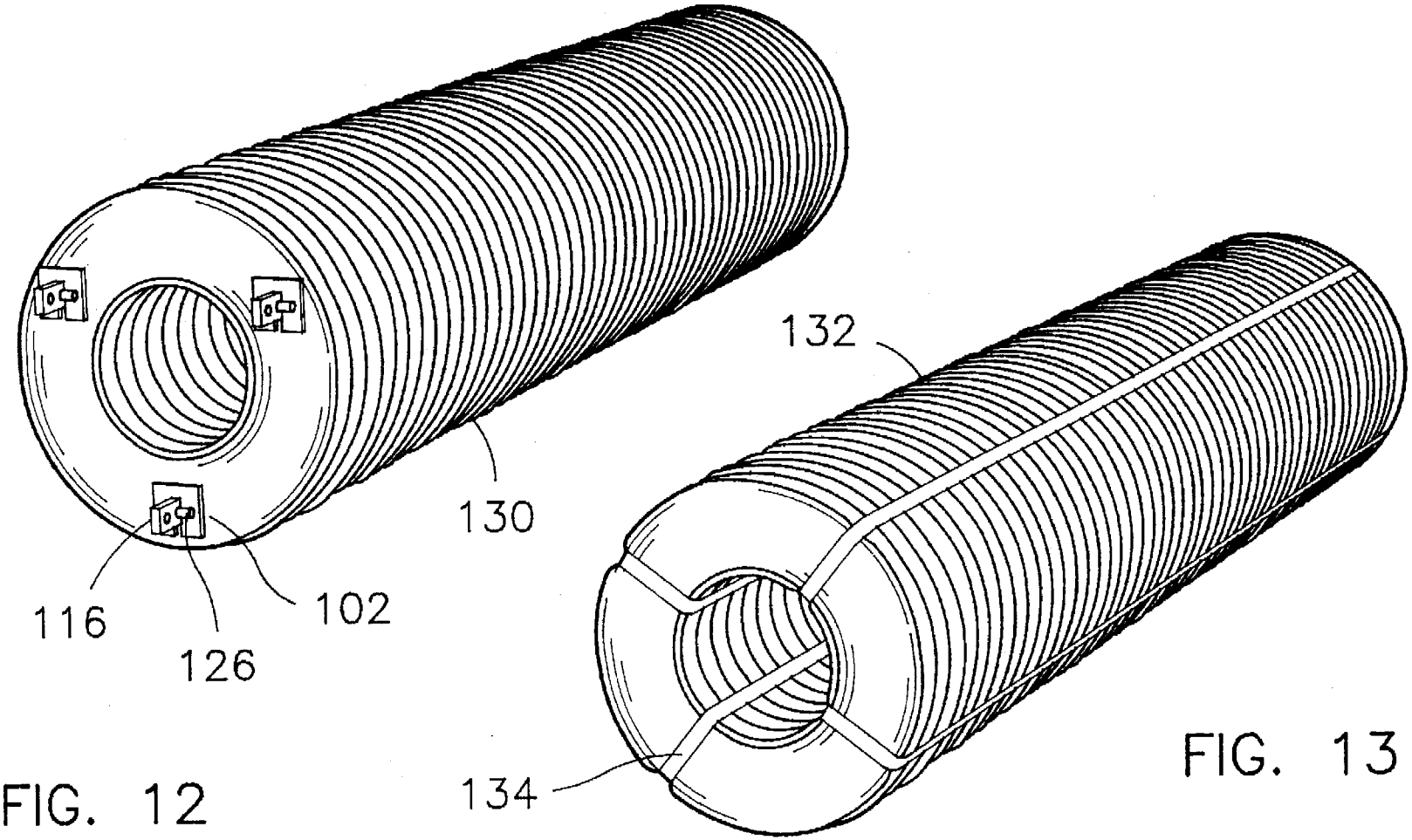
FIG. 12 is a first preferred embodiment of a pipe manufactured from discarded vehicle tires, and tied with tie rods through the sidewalls of the tires.
FIG. 13 is a second preferred embodiment of a pipe manufactured from discarded tires, and tied with strapping bands through the center of the pipe and around the exterior surface of the pipe.

Once the slotted holding plates 102 have been installed on the end of the tie rods 116 by means of lock pins 126, as seen in FIG. 12, the lock pins 118 may be removed from the clevis connection without disengaging the clevis connection 114 from the tie rods. At this point the first compactor plate 34 is removed from the cylindrical tubing. The plunger cylinders 56 are extended again with the hydraulic cylinders 54 fully extended, such that all clevis connections 114 push against the end of the tie rods 116 to move the bundle of compressed tires 122 off the telescopic mandrel 28 and onto an auxiliary transport trailer (not shown).

FIG. 12 illustrates a first pipe 130 made of discarded tires held in a compressed state by three tie rods 116 with holed holding plates 100 (not shown), and slotted holding plates 102. This pipe is tied according to a first preferred method of tying a bundle of vehicle tires.

An alternate embodiment of a culvert pipe 132 manufactured on the tire compressing machine of the preferred embodiment is tied with strapping bands 134 through the center of the bundle of tires and around the exterior surface of the bundle. It will become apparent to the person skilled in the an of compressing discarded tires that the clevis connection 114 may be used to pull a strapping band 134 through the side walls of tires in a similar manner as for pulling tie rod 116. The strapping bands 134 may thereafter be tied around the outside surface of the bundle 132 or inside the central opening of the bundle 132 to satisfy a particular application of that pipe.

Figure 14:
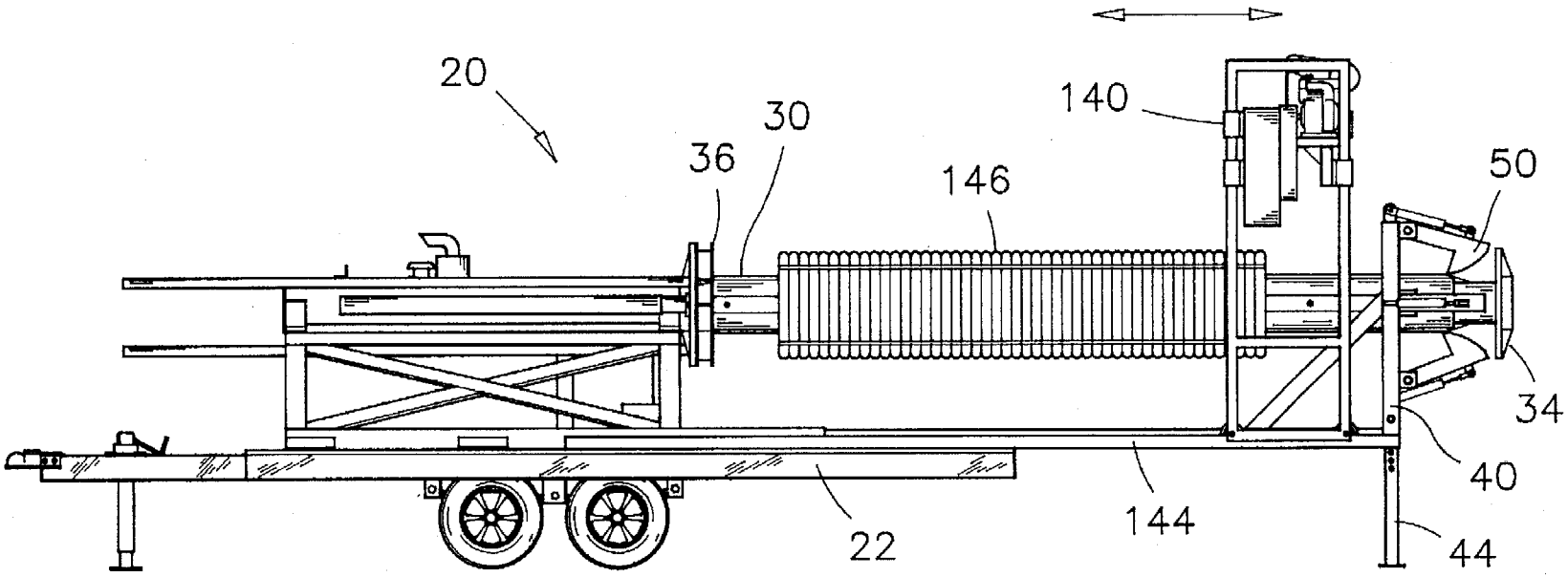
FIG. 14 illustrates a band saw mounted on the tire compressing machine of the preferred embodiment, for squaring up pipes made of vehicle tires.
Figure 16:
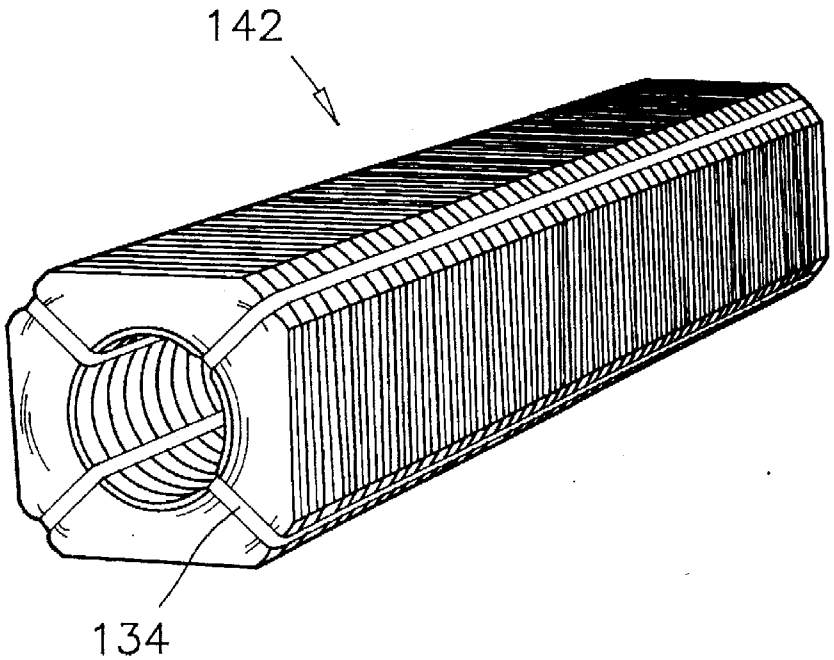
FIG. 16 is a pipe made of vehicle tires having four flat surfaces along the length thereof forming thereby a square log of tires.
Figure 15:
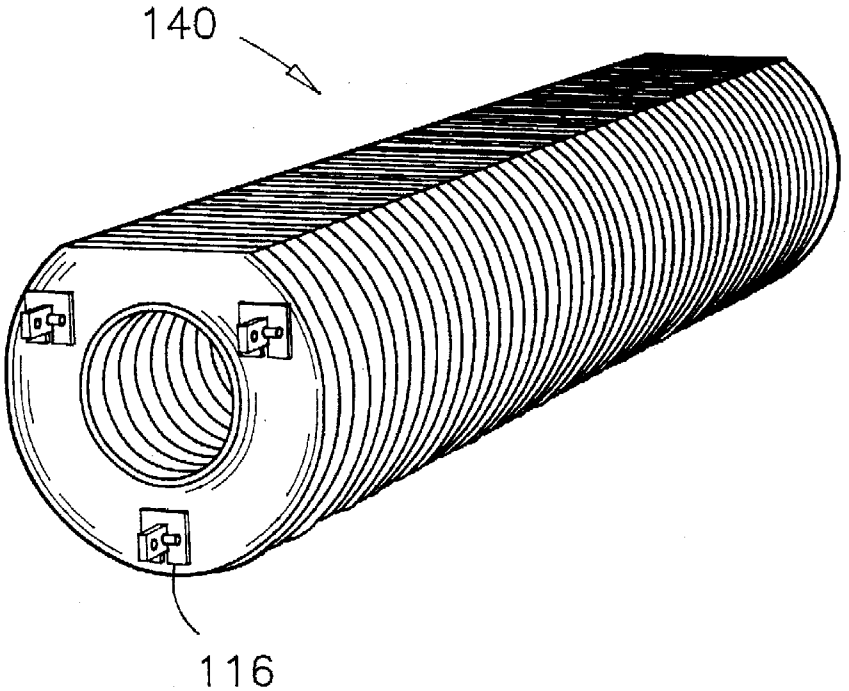
FIG. 15 is a pipe made of vehicle tires having one flat surface along the length of thereof.

Referring now to FIGS. 14, 15 and 16, the tire compressing machine 20 of the preferred embodiment comprises also an optional band saw 140 mounted thereon for squaring up a bundle of discarded tires into a slabbed log of tires 140 as shown in FIG. 15, or a square log of tires 142 as shown in FIG. 16. The slabbed log 140 is particularly useful for making a culvert pipe for use in a rocky formation where the flattened portion of the pipe in intended to be flushed with the ground for example. Similarly, the square log of tires 142 is useful as a culvert pipe where several pipes are placed side by side for making a larger capacity culvert. Other applications for the square log of tires 142 includes embankments, irrigation pads and barriers of all sorts.

The preferred band saw 140 for use on the tire compressing machine of the preferred embodiment is the type manufactured by Laskowski Enterprises Inc. in Indianapolis, Ind., U.S.A. and in Portland, Oreg., U.S.A. under the trade name Wood-Mizer™, or by Enercraft in Hillsdale, Ontario, Canada under the trade name Silva-Saw™. The band saw 140 is preferably supported inside two channels 144 affixed to the trailer 22 and to the support frame 40 of the grabber module. The band saw 140 has a frame and caster means such that it travels along the full length of a bundle of discarded tires 146 when pulled by a cable drive or similar drive means (not shown).

A bundle of tires 146 is slabbed in a tied mode, with the second compactor plate 36 fully retracted and the grabber jaws 50 closed on the tubular casing 30 for rigidly holding the tubular casing. The tied bundle 126 is preferably moved in a mid region along the tubular casing 30 prior to slabbing it.

The tied bundle 146 is also preferably rotated on the tubular casing 30 with peaveys by the persons operating this machine, for making a square log of tires 142 as shown in FIG. 16. For this purpose, the overall diameter of the exterior surface of the spacers 60 on the tubular casing 30 is preferably slightly smaller than a rim diameter of the discarded tires in a bundle such that the interference between that bundle 146 and the spacers 60 is a loose fit, as illustrated by circle 106 in FIG. 6.

Although the tire compressing machine of the preferred embodiment is capable of forming pipes of discarded tires having in excess of 100 discarded vehicle tires, the machine is relatively compact in size. A preferred overall length of the tubular casing is 24 feet, and a preferred platform length of the trailer 22 is about between 16 to 18 feet. Hence, the tire compressing machine is relatively easy and inexpensive to manufacture. It is also easily moved along a highway between piles of discarded tires.

While the above description provides a full and complete disclosure of the preferred embodiment of this invention, various modifications, alternate constructions and equivalents may be employed without departing from the true spirit and scope of the invention. Such changes might involve alternate components, structural arrangements, operable features or the like. Therefore the above description and accompanying illustrations should not be construed as limiting the scope of the invention which is defined by the appended claims.

I claim:

1. A method for manufacturing pipes made of discarded vehicle tires on an apparatus comprising a telescopic mandrel, a first compactor plate on a free end of an extensible portion of said mandrel, a second compactor plate on an intermediate position along a fixed portion of said telescopic mandrel and compression retention means rigidly mounted between said first and second compactor plates; said method comprising the steps of:

removing said first compactor plate from a free end of said extensible portion of said telescopic mandrel;

placing a first batch of discarded vehicle tires on said extensible portion of said telescopic mandrel, installing said first compactor plate on said free end of said extensible end of said telescopic mandrel;

moving said extensible portion toward said second compactor plate thereby compacting said first batch of discarded vehicle tires against said second compactor plate;

retaining with said compression retention means said first batch of vehicle tires in a compressed mode against said second compactor plate, while extending said extensible portion of said telescopic mandrel and loading a second batch of vehicle tires on said extension portion of said telescopic mandrel;

pulling and compressing said second or subsequent batch of discarded vehicle tires against said first batch thereby forming a pipe of discarded vehicle tires;

tying said pipe of vehicle tires thereby retaining a compressed state of said pipe.

2. A method for manufacturing pipes made of discarded vehicle tires as claimed in claim 1 comprising the additional step of pushing said second compactor plate toward said first compactor plate for effecting a further compression of said pipe of vehicle tires.

3. A method for manufacturing pipes made of discarded vehicle tires as claimed in claim 2 comprising the further steps of:

puncturing holes through the sidewalls of all tires in said pipe of vehicle tires;

pulling a tie rod in each tying said holes; and tying said tie rod to holding plates on end surfaces of said pipe for retaining said pipe in a compressed mode.

4. A method for manufacturing pipes made of discarded vehicle tires as claimed in claim 2 comprising the further steps of:

puncturing holes through the sidewalls of all tires in said pipe of vehicle tires;

pulling a strapping band through each of said holes; and tying said strapping band around an exterior surface of said pipe for retaining said pipe in a compressed mode.

5. A method for manufacturing pipes made of discarded vehicle tires as claimed in claim 2 comprising the further step of sawing a longitudinal slab from said pipe.

* * * * *